US005750321A

United States Patent [19]

Texter et al.

[11] Patent Number: 5,750,321

[45] Date of Patent: May 12, 1998

[54] PROCESS FOR BUFFERING CONCENTRATED AQUEOUS SLURRIES

[75] Inventors: John Texter, Rochester; Ravi Sharma, Fairport; David Alan Czekai, Honeoye Falls, all of N.Y.

[73] Assignee: Eastman Kodak Company, Rochester, N.Y.

[21] Appl. No.: 786,069

[22] Filed: Jan. 21, 1997

Related U.S. Application Data

[60] Division of Ser. No. 417,876, Apr. 6, 1995, Pat. No. 5,609,998, which is a continuation-in-part of Ser. No. 366,088, Dec. 29, 1994, abandoned.

[51] Int. Cl.[6] ..... G03C 1/38

[52] U.S. Cl. ..... 430/449; 430/450; 430/546; 430/631

[58] Field of Search ..... 430/546, 569, 430/631, 449, 450; 424/400; 514/937

[56] References Cited

U.S. PATENT DOCUMENTS

| | | | |
|---|---|---|---|
| 3,676,147 | 7/1972 | Boyer et al. | 430/569 |
| 3,743,613 | 7/1973 | Coulter et al. | 523/131 |
| 3,999,993 | 12/1976 | Patel et al. | 430/289 |
| 4,006,025 | 2/1977 | Swank et al. | 430/567 |
| 4,110,400 | 8/1978 | Jha et al. | 423/141 |
| 4,155,741 | 5/1979 | Scher et al. | 504/112 |
| 4,161,566 | 7/1979 | Higgins | 428/454 |
| 4,266,014 | 5/1981 | Moelants et al. | 430/522 |
| 4,318,848 | 3/1982 | Molls et al. | 260/143 |
| 4,465,495 | 8/1984 | Scheffee | 44/280 |
| 4,540,603 | 9/1985 | Hidaka et al. | 437/211 |
| 4,623,476 | 11/1986 | Nayar et al. | 252/94 |

(List continued on next page.)

FOREIGN PATENT DOCUMENTS

| | | |
|---|---|---|
| 0 569 074 | 11/1993 | European Pat. Off. . |
| 2453902 | 5/1975 | Germany . |
| 3246826 | 6/1983 | Germany . |
| 1570362 | 7/1980 | United Kingdom . |

*Primary Examiner*—Hoa Van Le
*Attorney, Agent, or Firm*—Paul A. Leipold

[57] ABSTRACT

A process for buffering concentrated aqueous slurries comprising the steps of:

providing a particulate solid substance comprising a weak acid functional group, having effective $pK_{a1}>1$ and less than 1% by weight aqueous solubility at $pH=pK_{a1}$;

providing an aqueous solution consisting essentially of water or a mixture of water with water-miscible solvent, at pH less than the greater of 7 and $pK_{a1}+2$;

providing a buffering salt of a weak acid, where the weak acid associated with this buffering salt has $pK_{a2}$ and where $pK_{a1}-2 \leqq pK_{a2}$; and combining said aqueous solution, said particulate solid substance, and said buffering salt to form a slurry;

wherein said process is essentially devoid of any step comprising the addition of any weak acid, other than that arising from reaction between said buffering salt and said particulate solid substance, having greater than 2% by weight aqueous solubility at $pH=pK_{a1}$ is disclosed.

An aqueous-based slurry comprising:

a particulate solid substance comprising a weak acid functional group having effective $pK_{a1}>1$ and less than 1% by weight aqueous solubility at $pH=pK_{a1}$;

an aqueous continuous phase at $pH<pK_{a1}+3$;

a buffering salt of a weak acid, where the weak acid associated with this buffering salt has $pK_{a2}$ and where $pK_{a1}-2 \leqq pK_{a2}$; and where the incremental molar ionic strength in the continuous phase of said slurry resulting from said buffering salt is less than 0.04 mol/L is disclosed.

15 Claims, 1 Drawing Sheet

U.S. PATENT DOCUMENTS

| | | | |
|---|---|---|---|
| 4,861,592 | 8/1989 | Gottwald et al. | 424/687 |
| 4,900,652 | 2/1990 | Dickerson et al. | 430/502 |
| 4,975,465 | 12/1990 | Motola et al. | 514/557 |
| 5,110,717 | 5/1992 | Czekai et al. | 430/512 |
| 5,145,684 | 9/1992 | Liversidge et al. | 424/489 |
| 5,240,821 | 8/1993 | Texter et al. | 430/405 |
| 5,274,109 | 12/1993 | Texter | 548/365.4 |
| 5,360,695 | 11/1994 | Texter | 430/203 |
| 5,401,623 | 3/1995 | Texter | 430/546 |

PROCESS FOR BUFFERING CONCENTRATED AQUEOUS SLURRIES

CROSS REFERENCE TO RELATED APPLICATIONS

This is a Divisional of application Ser. No. 08/417,876, filed Apr. 6, 1995 now U.S. Pat. No. 5,609,998, which in turn was a continuation-in-part of 08/366,088 filed Dec. 29, 1994, now abandoned.

FIELD OF THE INVENTION

This invention relates to the buffering of nanoparticulate aqueous slurries and to the production of nanoparticulate slurries by comminution means.

BACKGROUND OF THE INVENTION

Acids and Bases in Slurries

The use of acids and bases for controlling pH in slurries is widely known. Buffering agents are employed to provide a buffered environment in which moderate amounts of either a strong base or acid may be added without causing any large change in pH. A buffer solution usually contains a weak acid and a salt of the weak acid, an acid salt with a normal salt or a mixture of two acid salts.

Coulter et al., in U.S. Pat. No. 3,743,613, disclose a particulate galactomannan gum based composition for sealing permeable formations. The composition contains a pH control agent to maintain pH of the initial slurry at about 7.5, preferably in the range of 8–12. A hydroxyl ion source such as any soluble or partially soluble hydroxide or carbonate in an amount to yield the desired pH may be used. Suitable buffering agents which may be employed to provide to provide the desired pH are $NaH_2PO_4/Na_2HPO_4$, boric acid/sodium hydroxide, acetic acid/sodium hydroxide, boric acid/borax, sodium carbonate/sodium bicarbonate, and sodium bicarbonate.

Lotzgesell et al., in U.S. Pat. No. 3,975,206, disclose a method for thinning starch in slurries employing hydrogen peroxide and metal ion catalysts free of buffer additions. Earlier art described in U.S. Pat. No. 2,307,684 discloses the liquefaction of starch using hydrogen peroxide catalyzed by a metal salt or a metal, and the use of sodium carbonate or other alkali to regulate the final or end pH.

The process disclosed uses ammonium hydroxide as the buffering agent.

Jha et al., in U.S. Pat. No. 4,110.400, disclose a method for precipitating nickel sulfide from acidic nickel sulfate solution of pH 1.5–4. The method uses soluble sulfate to buffer the solution during the precipitation at relatively low temperature and pressure.

Scher and Cochran, in U.S. Pat. No. 4,155,741, disclose a stable suspension-buffer system for aqueous suspension of microencapsulated materials which can be obtained by using aluminum hydroxide or ferric hydroxide as the suspending and buffering agent. Also used are a sequestering agent and a second suspending agent to prevent separation and caking.

Higgins, in U.S. Pat. No. 4,161,566, disclose aqueous disperse compositions that may include buffers such as potassium dichromate/acetic acid and potassium dichromate/phosphoric acid combinations.

Hans-Heinze et al., in U.S. Pat. No. 4,318,848, disclose a process for the neutralization of basic reaction compositions that uses neutralization by addition of a free surface-active acid. After addition of acid, basic agents are not added or are only added up to a pH value of 3.

Scheffee, in U.S. Pat. No. 4,465,495, discloses a process for making fluid, stable slurries of finely divided coal in water and products thereof, which can be sufficiently highly loaded to serve as a fuel. Use of alkali metal buffer salts to stabilize pH in the 5–8 range is disclosed. Salts such as sodium or potassium phosphate or carbonate, including their acid salts, are used in minor amounts sufficient to provide the desired pH, e.g., about 0.1 to 2% based on the water.

In JP-61-185568 published Aug. 8, 1986, the preparation of pigment dispersions by dissolving one or more organic pigments together with a nonionic surfactant (e.g., polyoxyethylene lauryl ether) in an aprotic polar solvent (e.g., DMSO) in the presence of a caustic alkali (e.g., KOH) and water, neutralizing, and re-precipitating the solution and adding a heteropolyacid or tannic acid is disclosed.

Nayar et al., in U.S. Pat. No. 4,623,476, disclose stable suspensions of pigments in aqueous hypochlorite bleach compositions. Bleach stable inorganic buffering agents from about 0.2 to 10% by weight are disclosed that maintain composition pH within the range of 10.5–13.5. Sodium carbonate, calcium bicarbonate, sodium sesquicarbonate, sodium silicates, sodium orthophosphate, and sodium tetraborate are disclosed as buffering agents.

Gottwald and Machoczek, in U.S. Pat. No. 4,861,592, disclose a pharmaceutical composition suitable for oral administration comprising particulate cimetidine suspended in an aqueous phase containing a buffer which maintains the pH at greater than 7 and a suspending agent. Antacids such as aluminum hydroxide, magnesium hydroxide, magnesium carbonate, calcium carbonate, and mixtures are disclosed as agents that may be incorporated in the composition in order to maintain the pH greater than 8.

Motola et al., in U.S. Pat. No. 4,975,465, disclose a liquid aqueous based ibuprofen composition, wherein the ibuprofen is maintained in suspension by a combination of primary suspending agents and wherein a buffer acid is incorporated to adjust the pH of the composition to between 1.5 and 3.5. Compositions containing citric acid or phosphoric acid in an amount of 0.1% to 2% weight by volume are suggested. Sodium benzoate/citric acid and sodium benzoate/phosphoric acid containing ibuprofen compositions are disclosed.

Usagawa et al., in EP 0 435 561 A3, disclose silver halide materials containing solid particle dispersions of acidic 2-pyrazoline-5-one based filter dyes. Usagawa et al. teach the addition of small amounts of organic acids, such as acetic acid, citric acid, oxalic acid, and tartaric acid for the adjustment of pH.

Stude et al., in DE 4 103 283 A, disclose an interlayer material for separating stored glass sheets. This material comprises finely divided PVC, PMMA, etc., buffered to pH 1–6 with a suitable buffer system containing an indicator such as phenolphthalein. A Sorensen-Clark buffer system is used.

Nanoparticulate Slurries and Solid Particle Dispersion Technology

The art of precipitation of organic substances having relatively low water solubility,, starting from a solution state to a stable fine particle colloidal dispersion is known. Such precipitation is generally achieved by dissolving the substance in a water-miscible solvent aided by addition of base to ionize the substance, addition of a dispersing aid with subsequent precipitation of the substance by lowering pH or by shifting the concentration of two or miscible solvents such that the substance is no longer soluble in the continuous phase and precipitates as a colloidal dispersion or slurry.

Townsley et al., in U.K. Pat. No. 1,193,349, disclose a process whereby a color coupler is dissolved in a mixture of water-miscible organic solvent and aqueous alkali. The coupler solution is then mixed with an aqueous acid and a protective colloid, to form a dispersion of the color coupler by pH shift. Such a dispersion can be mixed with an aqueous silver halide emulsion and coated on a support, and incorporated into Ea photographic element.

Langen et al., in U.K. Pat. No. 1,570,362 disclose the use of solid particle milling methods such as sand milling, bead milling, dyno milling, and related media, ball, and roller milling methods for the production of solid particle dispersions of photographic additives such as couplers, UV-absorbers, UV stabilizers, white toners, stabilizers, and sensitizing dyes.

Jelly and Vittum, in U.S. Pat. No. 2,322,027, disclose a method for incorporating hydrophobic couplers into photographic elements. The method comprises dissolving the coupler in a high boiling water immiscible solvent, mixing with aqueous gelatin, and dispersing using a colloid mill or homogenizer. Such methods are applicable for creating aqueous dispersions of hydrophobic substances in general, and can be effectively used for creating oil in water emulsions of any two immiscible fluids or solvent solutions.

Boyer and Caridi, in U.S. Pat. No. 3,676,147, disclose a method of ball-milling sensitizing dyes in organic liquids as a means of spectrally sensitizing silver halide emulsions. Langen et al., in Canadian Patent No. 1,105,761, disclose the use of solid particle milling methods and processes for the introduction of sensitizing dyes and stabilizers in aqueous silver salt emulsions.

Swank and Waack, in U.S. Pat. No. 4,006,025, disclose a process for dispersing sensitizing dyes, wherein said process comprises the steps of mixing the dye particles with water to form a slurry and then milling said slurry at an elevated temperature in the presence of a surfactant to form finely divided particles. Onishi et al., in U.S. Pat. No. 4,474,872, disclose a mechanical grinding method for dispersing certain sensitizing dyes in water without the aid of a dispersing agent or wetting agent. This method relies on pH control in the range of 6–9 and temperature control in the range of 60°–80° C.

Moelants and Depoorter, in U.S. Pat. No. 4,266,014, Lemahieu et al., in U.S. Pat. No. 4,288,534, Postle and Psaila, in U.S. Pat. Nos. 4,294,916 and 4,294,917, 1981, Anderson and Kalenda, in U.S. Pat. No. 4,357,412, Ailliet et al., in U.S. Pat. No. 4,770,984, Factor and Diehl, in U.S. Pat. No. 4,855,221, Diehl and Reed, in U.S. Pat. No. 4,877,721, Dickerson et al., in U.S. Pat. No. 4,900,652, Factor and Diehl, in U.S. Pat. No. 4,900,653, Schmidt and Roca, in U.S. Pat. No. 4,904,565, Shuttleworth et al., in U.S. Pat. No. 4,923,788, Diehl and Factor, in U.S. Pat. No. 4,940,654, Diehl and Factor, in U.S. Pat. No. 4,948,717, Factor and Diehl, in U.S. Pat. No. 4,948,718, Diehl and Brown, in U.S. Pat. No. 4,994,56, disclose filter dyes and solid particle dispersions of dyes for use as filter dyes in photographic elements. They disclose that such dyes can be dispersed as solid particle dispersions by precipitating or reprecipitating (solvent or pH shifting), by ball-milling, by sand-milling, or by colloid-milling in the presence of a dispersing agent. Photographic elements containing such filter dyes and dispersions thereof are disclosed.

Chari et al., in U.S. Pat. No. 5,008,179, discloses methods for forming dispersions of photographic couplers, wherein aqueous dispersions of photographic coupler and of activating permanent solvent are combined and mixed with silver halide emulsion.

Texter et al., in U.S. Pat. No. 5,240,821, disclose solid particle dispersions of developer precursors, and photographic elements containing such dispersions. Texter, in U.S. Pat. No. 5,274,109, discloses microprecipitated methine oxonol filter dye dispersions. These dispersions are prepared with close attention paid to the stoichiometric amounts of acid used in the microprecipitation process.

Texter, in U.S. Pat. No. 5,360,695, discloses solid particle thermal solvent dispersions and aqueous developable dye diffusion transfer elements containing them. Texter, in U.S. Ser. No. 07/956,140, now U.S. Pat. No. 5,401,623, discloses nanoparticulate microcrystalline coupler dispersions wetted with coupler solvent. Texter, in U.S. Ser. No. 08/125,990 filed Sep. 23, 1993, now U.S. Pat. No. 5,142,414, discloses solid particle coupler dispersions for use in color diffusion transfer element.

Oppenheim et al., in U.S. Pat. No. 4,107,288, disclose the incorporation of biologically active drug substances in nanoparticulates of cross-linked macromolecules. The size of such nanoparticulates is in the range of 10 to 1000 nm. EPO 275,796 discloses the formation of nanoparticulate particles of drug substances by precipitation, using solvent shifting methods. Such methods produce nanoparticulate precipitates in the form of spherical particles less than 500 nm in diameter, wherein the precipitated material is in an amorphous physical state. This method of dispersing drug substance in a nanoparticulate form suffers from the requirement of having to remove toxic solvents from the resulting dispersions.

Motoyama et al., in U.S. Pat. No. 4,540,603, disclose the formation of 500 to 5000 nm particulates of solid drug substance by wet grinding methods. Liversidge et al., in U.S. Pat. No. 5,145,684, disclose the formation of nanoparticulate drug substances with an average particles size of less than 400 nm, wherein the drug substance typically is in a microcrystalline physical state. The nanoparticulates of Liversidge et al. comprise drug substances having a solubility in water of less than 10 mg/ml, and generally are 10–99.9% by weight crystalline drug substance. Wet grinding methods of preparing such particles and suspensions thereof are also disclosed by Liversidge et al.

Problem to be Solved by the Invention

Aqueous slurries and dispersions of particulates and nanoparticulates are typically stabilized against flocculation and coagulation by the use of steric stabilizers and/or by the use of charge stabilizers. Adsorption on particulate surfaces of charge stabilizers, such as charged surfactants, generally serve to increase the electrokinetic surface charge of such surfaces, and to provide a coulombic repulsive force between separate particles. When ionic strength is significantly increased, as occurs when typical buffers are added to slurries in order to modify the pH of the continuous phase, the increased ionic strength serves to screen the coulombically repulsive charges from adsorbed surfactant, and to significantly decrease colloidal stability, resulting in increased flocculation and coagulation of the constitutive particulates to form aggregates of particulates. Such aggregates cause problems in filtration, coating, and sedimentation.

Conventional wet milling processes using ceramic or glass milling media result in leaching of metal hydroxides. Such hydroxides tend to increase pH and ionic strength, further destabilizing dispersions. Conventional buffer formulations further exacerbate this problem.

SUMMARY OF THE INVENTION

It is an object of the present invention to provide processes and compositions of controlled pH with minimization of deleterious colloidal stability effects.

It is an object of the present invention to provide improved pH control during dispersing processes in order to minimize heterocoagulation during comminution and milling.

It is an object of the present invention to provide enhanced pH control in concentrated aqueous slurries and suspensions utilizing a minimal quantity of buffering agent.

It is an object of the present invention to provide pH control to avoid decomposition or solubilization of pH-sensitive substances dispersed as particulates.

These and other objects are generally obtained by executing a process for buffering concentrated aqueous slurries comprising the steps of:

providing a particulate solid substance comprising a weak acid functional group, having effective $pK_{a1}>1$ and less than 1% by weight aqueous solubility at $pH=pK_{a1}$;

providing an aqueous solution consisting essentially of water or a mixture of water with water-miscible solvent, at pH less than the greater of 7 and $pK_{a1}+2$;

providing a buffering salt of a weak acid, where the weak acid associated with this buffering salt has $pK_{a2}$ and where $$pK_{a1}-2 \leqq pK_{a2};$$

and combining said aqueous solution, said particulate solid substance, and said buffering salt to form a slurry;

wherein said process is essentially devoid of any step comprising the addition of any weak acid, other than that arising from reaction between said buffering salt and said particulate solid substance, having greater than 2% by weight aqueous solubility at $pH=pK_{a1}$.

These objects of the invention in another embodiment may also be accomplished by providing an aqueous-based slurry comprising:

a particulate solid substance comprising a weak acid functional group having effective $pK_{a1}>1$ and less than 1% by weight aqueous solubility at $pH=pK_{a1}$;

an aqueous continuous phase at $pH<pK_{a1}+3$;

a buffering salt of a weak acid, where the weak acid associated with this buffering salt has $pK_{a2}$ and where $$pK_{a1}-2 \leqq pK_{a2};$$

and where the incremental molar ionic strength in the continuous phase of said slurry resulting from said buffering salt is less than 0.04 mol/L.

Advantageous Effect of the Invention

The invention has numerous advantages over the prior art. The present invention overcomes the previously unrecognized problem of unwanted and uncontrolled ripening induced by local concentration excesses of hydroxide, from alkali addition in attempts to raise the pH of slurries and dispersions of organic materials and substances having weak acid functional groups of effective $pK_{a1}>1$. The present invention overcomes the problem of dispersion and slurry destabilization by Coulombic screening that attends, the addition of buffer solutions, and allows pH to be controlled utilizing the buffering capability of the particulate solid phase surfaces with only minor additions of salts of weak acids that do not significantly increase the ionic strength of the continuous phase.

DETAILED DESCRIPTION OF THE INVENTION

Figure 1:
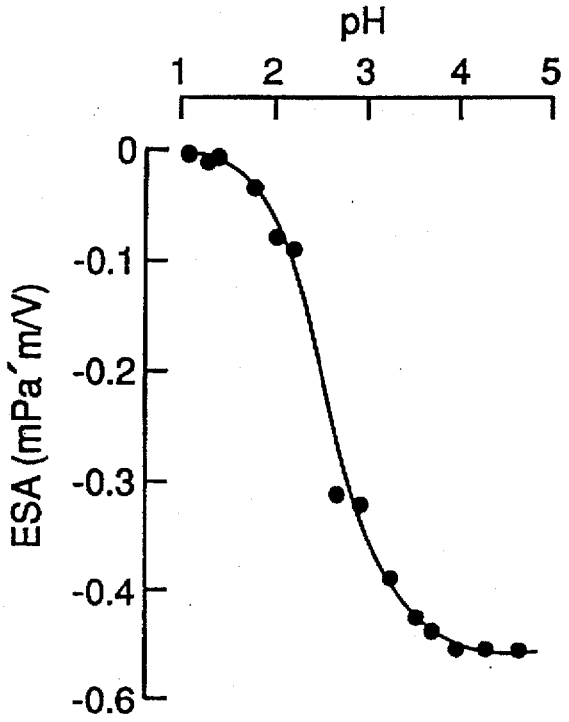
FIG. 1. ESA as a function of pH for FD1 slurry S1.

The term solid particle dispersion means a dispersion of particles wherein the physical state of particulate material is solid rather than liquid or gaseous. This solid state may be an amorphous state or a crystalline state. The expression microcrystalline particles means that said particles are in a crystalline physical state. In preferred embodiments of the present invention, said particles are smaller than 5 μm and larger than 0.01 μm in average dimension and more preferably smaller than 0.5 μm and larger than 0.01 μm in average dimension.

Dispersed Materials and Substances

The slurries and processes of the present invention are obtained with a particulate solid substance comprising a weak acid functional group, having $pK_{a1}>1$ and low aqueous solubility at $pH \leqq pK_{a1}$. Preferred organic materials and substances having weak acid functional groups of effective $pK_{a1}>1$ of the present invention have less than 1% by weight aqueous solubility at $pH=pK_{a1}$, since such materials will tend to ripen and recrystallize less during pH excursions in the neighborhood of $pK_{a1}$. Particularly preferred organic materials and substances having weak acid functional groups of effective $pK_{a1}>1$ of the present invention have less than 0.1% by weight aqueous solubility at pH less than $pK_{a1}$, since such materials will tend to ripen and recrystallize much less during pH excursions in the neighborhood of $pK_{a1}$.

There are numerous photographically useful materials and substances of the present invention having weak acid functional groups of effective $pK_{a1}>1$ and having low aqueous solubility. These substances include dyes, filter dyes, sensitizing dyes, antihalation dyes, absorber dyes, UV dyes, stabilizers, UV stabilizers, redox dye-releasers, positive redox dye releasers, couplers, colorless couplers, competing couplers, dye-releasing couplers, dye precursors, development-inhibitor releasing couplers, development inhibitor anchimerically releasing couplers, photographically useful group releasing couplers, development inhibitors, bleach accelerators, bleach inhibitors, electron transfer agents, oxidized developer scavengers, developing agents, competing developing agents, dye-forming developing agents, developing agent precursors, silver halide developing agents, color developing agents, paraphenylenediamines, para-aminophenols, hydroquinones, blocked couplers, blocked developers, blocked filter dyes, blocked bleach accelerators, blocked development inhibitors, blocked development restrainers, blocked bleach accelerators, silver ion fixing agents, silver halide solvents, silver halide complexing agents, image toners, pre-processing image stabilizers, post-processing image stabilizers, hardeners, tanning agents, fogging agents, antifoggants, nucleators, nucleator accelerators, chemical sensitizers, surfactants, sulfur sensitizers, reduction sensitizers, noble metal sensitizers, thickeners, antistatic agents, brightening agents, discoloration inhibitors, and other addenda known to be useful in photographic materials. Among these useful materials of the present invention are blocked compounds and useful blocking chemistry described in U.S. Pat. Nos. 4,690,885, 4,358,525, 4,554,243, 5,019,492, and 5,240,821 the disclosures of which are incorporated by reference herein in their entirety for all they disclose about useful photographic substances and the use of these substances in photographic elements. Numerous references to patent specifications and other publications describing these and other useful photographic substances are given in *Research Disclosure,* December 1978, Item No. 17643, published by Kenneth Mason Publications, Ltd. (The Old Harbormaster's, 8 North Street, Emsworth, Hampshire P010 7DD, England) and in T. H. James, *The Theory of The Photographic Process,* 4th Edition, Macmillan Publishing Co., Inc. (New York, 1977).

Preferred filter dyes used as particulate solid substances in the present invention are described in copending, commonly assigned European Patent Application 0 549 489 A1 and in U.S. application Ser. No. 07/812,503, *Microprecipitation Process for Dispersing Photographic Filter Dyes* of Texter et al., filed Dec. 20, 1991, as compounds I-1 to I-6, II-1 to II-46, III-1 to III-36, IV-1 to IV-24, V-1 to V-17, VI-1 to VI-30, and VII-1 to VII-276 therein. The disclosure of U.S. application Ser. No. 07/812,503 is incorporated herein by reference.

Particularly preferred filter dyes used as particulate solid substances in the present invention, because of their ease of manufacture and efficacy in photographic elements, include the following:

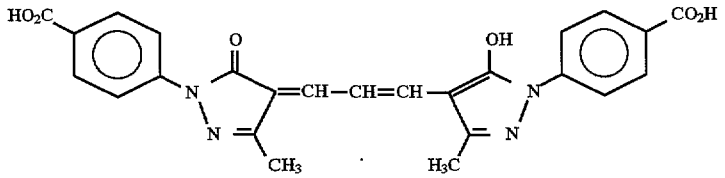

FD1

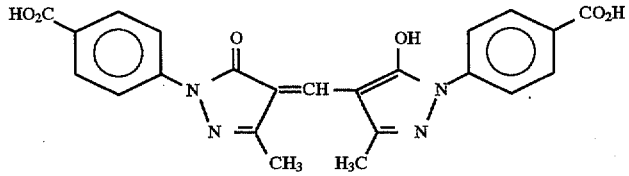

FD2

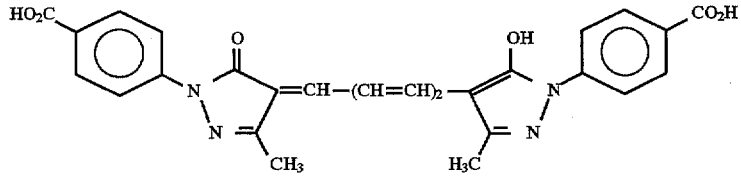

FD3

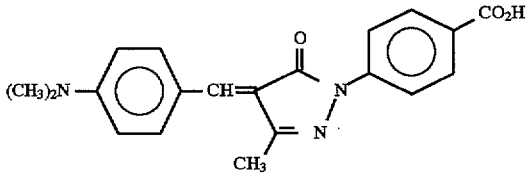

FD4

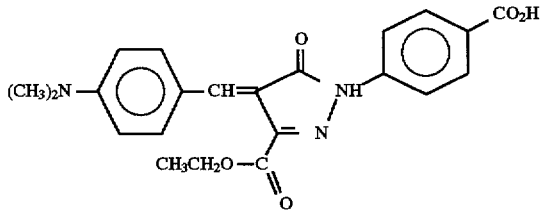

FD5

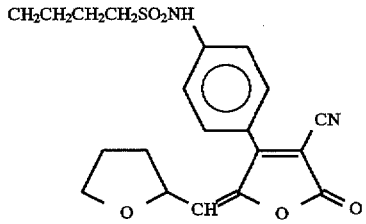

FD6

Suitable couplers and dye-forming compounds for the particulate solid substance of the present invention are described in U.S. Pat. Nos. 3,227,550, 3,443,939, 3,498,785, 3,734,726, 3,743,504, 3,928,312, 4,076,529, 4,141,730, 4,248,962, 4,420,556, and 5,322,758, the disclosures of which are incorporated herein by reference for all they teach about couplers and dye-forming compounds substituted with weakly acidic aqueous solubilizing groups.

Suitable blocked color developers for the particulate solid substance of the present invention are described in U.S. Pat. Nos. 5,240,821 and 5,256,525, especially compounds 6 and 8–35 in No. 5,240,821, the disclosures of which are incorporated herein by reference for all they teach about blocked developer compounds substituted with weakly acidic aqueous solubilizing groups.

There are numerous pharmaceutically useful materials and substances of the present invention having weak acid functional groups of effective $pK_{a1}>1$ and having low aqueous solubility. These substances include analgesics, anti-inflammatory agents, anthelmintics, anti-arrhythmic agents, antibiotics, anticoagulants, antidepressants, antidiabetic agents, antiepileptics, antihistamines, antihypertensive agents, antimuscarinic agents, antimycobacterial agents, antineoplastic agents, antiparkinsonian agents, antithyroid agents, antiviral agents, anxioloytic sedatives, astringents, beta-adrenoceptor blocking agents, biphosphonates, blood products and substitutes, cardiac inotropic agents, contrast agents, contrast media, corticosteroids, cough suppressants, diagnostic agents, diagnostic imaging agents, diuretics, dopaminergics, expectorants, haemostatics, hypnotics, imaging agents, immunosuppressants, immunological agents, lipid regulating agents, mucolytics, muscle relaxants, neuroleptics, parasympathomimetics, parathyroid calcitonin, penicillins, prostaglandins, radiopharmaceuticals, sex hormones, anti-allergic agents, steroids, stimulants, anoretics, sympathomimetics, thyroid agents, vasodilators, and xanthine. Preferred pharmaceutical agents are those intended for oral administration, for intravenous injection, for intramuscular injection, for subcutaneous injection, and for subdural injection. Many useful pharmaceutical materials and substances of the present invention are disclosed in The Merck Index, Eleventh Edition, edited by S. Budavari and published by Merck & Co., Inc., Rahway, N.J. (1989).

There are numerous organically-based pigments that are useful materials and substances of the present invention having weak acid functional groups of effective $pK_{a1}>1$ and having low aqueous solubility. These substances include azo pigment dyestuffs, azo toners and lakes, phthalocyanine pigments, thioindigo derivatives, anthraquinone pigments, quinacridine pigments, dioxazine pigments, isoindolinone pigments, and acid dyestuffs. The preparation of these pigments is described by W. M. Morgans in Chapter 7 of *Outlines of Paint Technology,* Third Edition, pages 113–133, and published by Halsted Press, 1990.

Preferred organic materials and substances having weak acid functional groups of effective $pK_{a1}>1$ of the present invention have carboxyl, —COOH, or sulfonamido, —$SO_2NHR$, weak acid functional groups. R in —$SO_2NHR$, is hydrogen, substituted or unsubstituted alkyl, or substituted or unsubstituted aryl. Such materials and substances can be bufferred readily using the buffering salts of the present invention.

Weak Acids and Buffering Salts

The buffering salts of the present invention are salts of weak protonic acids, where these weak protonic acids have pK>0. Such salts are well known in the art, readily available commercially, and are readily prepared from weak protonic acids by ion exchange methods and by other methods well known in the art. Suitable weak acids useful for preparing the buffering salts of the present invention are listed in Table 1.

Also suitable for the buffering salts of the present invention are those salts of weak acids that have been derivatized to modify solubility and surface activity. For example, benzoate salts having substituents on the benzene ring are suitable derivatives. Buffering salts comprising surface active anions are preferred, because their use provides buffering activity with minimal perturbation to the ionic strength of the continuous phase. Buffering salts comprising surface active anions that adsorb to the surfaces of particulates of materials and substances having weak acid functional groups and low aqueous solubility of the present invention are therefore useful.

Metal, onium, and quaternary salts of weak protonic acids having pK>0 are suitable buffering salts of the present invention. Alkali metal salts are preferred. Onium salts are preferred in some embodiments of the present invention, particularly when the onium cation is surface active and adsorbs to the particulate surfaces of the present invention. Salts of carboxylic acids are preferred buffering salts of the present invention because of their availability and moderate cost. Alkali metal salts of carboxylic acids are particularly preferred because of their availability and efficacy.

In a preferred embodiment, the buffering salt of the present invention is a salt of a material and substance of the present invention having a weak acid functional group and low aqueous solubility.

Suitable buffering salts of the present invention include ammonium acetate, ammonium benzoate, ammonium bimalate, ammonium binoxalate, ammonium caprylate, dibasic ammonium citrate, ammonium lactate, ammonium mandelate, ammonium oleate, ammonium oxalate, ammonium palmitate, ammonium picrate, ammonium salicylate, ammonium stearate, ammonium valerate, choline dihydrogen citrate, choline salicylate, choline theophyllinate, lithium acetate, lithium acetylsalicylate, lithium benzoate, lithium bitartrate, lithium formate, potassium acetate, potassium p-aminobenzoate, potassium binoxalate, potassium biphthalate, potassium bitartrate, monopotassium citrate, potassium citrate, potassium formate, potassium gluconate, potassium oxalate, potassium phenoxide, potassium picrate, potassium salicylate, potassium sodium tartrate, potassium sorbate, potassium tartrate, potassium tetroxalate, potassium xanthogenate, sodium acetate, sodium arsphenamine, sodium ascorbate, sodium benzoate, sodium bitartrate, sodium cholate, sodium citrate, sodium folate, sodium formate, sodium gluconate, sodium iodomethamate, sodium isopropyl xanthate, sodium lactate, sodium nitroprusside, sodium oxalate, sodium phenoxide, sodium propionate, sodium rhodizonate, and sodium salicylate. The preparation and source of these salts is described in references tabulated in *The Merck Index,* Eleventh Edition, edited by S. Budavari and published by Merck & Co., Inc., Rahway, N.J. (1989).

Weak acids having particular pK values are tabulated in Willi, *Helvetica Chimica Acta,* vol. 39, 1956, pages 46–56, in Exner and Janak, *Collection Czechoslov. Chem. Commun.,* vol. 40, 1975, pages 2510–2523, in *Buffers for pH and Metal Ion Control* by D. D. Perrin and B. Dempsey, Chapman and Hall, New York (1974), in King, pages 249–259 of *The Chemistry of Sulphonic Acids, Esters and Their Derivatives,* edited by S. Patai and Z. Rappoport, John Wiley & Sons, New York (1991), and in Trepka, Harrington, and Belisle, *J. Org. Chem.*, vol. 39, No. 8, 1974, pages 1094–1098.

TABLE 1

| Weak Acid | $pK_a$ at 25° C. |
|---|---|
| Trichloroacetic acid | 0.66 |
| Pyrophosphoric acid ($pK_{a1}$) | 0.85 |
| Oxalic acid ($pK_{a1}$) | 1.27 |
| $CH_3SO_2NHSO_2CH_3$ | 1.36 |
| 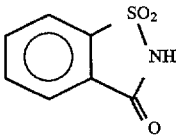 | 1.0 |
| Pyrophosphoric acid ($pK_{a2}$) | 1.96 |
| Sulfuric acid ($pK_{a2}$) | 1.96 |
| Maleic acid ($pK_{a1}$) | 2.00 |
| $CH_3CH_2SO_2NHSO_2CH_2CH_3$ | 2.04 |
| o-Aminobenzoic acid | 2.15 |
| Phosphoric acid ($pK_{a1}$) | 2.15 |
| Glycine ($pK_{a1}$) | 2.35 |
| 2-$CF_3$-4-Cl$-C_6H_3-NHSO_2CF_3$ | 2.59 |
| 2,4,6-trichloro-$C_6H_2-NHSO_2CF_3$ | 2.70 |
| Alanine ($pK_{a1}$) | 2.71 |
| trans-Aconitic acid ($pK_{a1}$) | 2.80 |
| p-$CH_3SO_2-C_6H_4-NHSO_2CF_3$ | 2.84 |
| 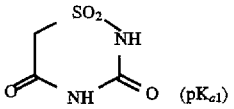 ($pK_{a1}$) | 2.88 |
| Chloroacetic acid | 2.88 |
| Malonic acid ($pK_{a1}$) | 2.88 |
| Phthalic acid ($pK_{a1}$) | 2.95 |
| Diglycollic acid ($pK_{1a}$) | 2.96 |
| 2,4-dichloro-$C_6H_3-NHSO_2CF_3$ | 2.96 |
| Salicylic acid ($pK_{a1}$) | 2.98 |
| Fumaric acid ($pK_{a1}$) | 3.03 |
| D(+)-Tartaric acid ($pK_{a1}$) | 3.04 |
| Citric acid ($pK_{a1}$) | 3.13 |
| Glycylglycine ($pK_{a1}$) | 3.14 |
| Furoic acid | 3.17 |
| p-$C_6H_5CO-C_6H_4-NHSO_2CF_3$ | 3.22 |
| Sulphanilic acid | 3.22 |
| p-$CH_3CO-C_6H_4-NHSO_2CF_3$ | 3.29 |
| Mandelic acid | 3.36 |
| Malic acid ($pK_{a1}$) | 3.40 |
| 2,4-difluoro-$C_6H_3-NHSO_2CF_3$ | 3.44 |
| m-$C_6H_5CO-C_6H_4-NHSO_2CF_3$ | 3.50 |
| Hippuric acid | 3.64 |
| m-$CF_3-C_6H_4-NHSO_2CF_3$ | 3.70 |
| 3,3-Dimethylglutaric acid ($pK_{a1}$) | 3.70 |
| m-$CH_3CO-C_6H_4-NHSO_2CF_3$ | 3.75 |
| Formic acid | 3.75 |
| Glycolic acid | 3.83 |
| Lactic acid | 3.86 |
| 2-$CH_3$-4-Cl$-C_6H_3-NHSO_2CF_3$ | 3.90 |
| p-Cl$-C_6H_4-NHSO_2CF_3$ | 3.90 |
| m-$NO_2-C_6H_4-NHSO_2NHCOCH_3$ | 3.97 |
| Barbituric acid | 4.04 |
| Benzoic acid | 4.20 |
| Succinic acid ($pK_{a1}$) | 4.21 |
| Oxalic acid ($pK_{a2}$) | 4.29 |
| D(+)-Tartaric acid ($pK_{a2}$) | 4.37 |
| Fumaric acid ($pK_{a2}$) | 4.38 |
| Diglycollic acid ($pK_{a2}$) | 4.43 |
| $C_6H_5-NHSO_2CF_3$ | 4.45 |
| trans-Aconitic acid ($pK_{a2}$) | 4.46 |
| Tetrakis-(2-hydroxyethyl)ethylenediamine ($pK_{2a}$) | 4.5 |

TABLE 1-continued

| Weak Acid | $pK_a$ at 25° C. |
|---|---|
| 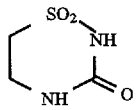 | 4.51 |
| p-Br$-C_6H_4-SO_2NHCOCH_3$ | 4.52 |
| Aniline | 4.66 |
| $C_6H_5-SO_2NHCOCH_3$ | 4.72 |
| Acetic acid | 4.76 |
| Citric acid ($pK_{a2}$) | 4.76 |
| Valeric acid | 4.80 |
| p-$CH_3CH_2-C_6H_4-NHSO_2CF_3$ | 4.82 |
| Butyric acid | 4.83 |
| Isobutyric acid | 4.83 |
| Propionic acid | 4.86 |
| $CH_3NHCOCH_2SO_2NHCONH_2$ | 4.89 |
| p-$CH_3O-C_6H_4-NHSO_2CF_3$ | 4.90 |
| p-$CH_3-C_6H_4-SO_2NHCOCH_3$ | 4.92 |
| Quinoline | 5.00 |
| $NH_2COCH_2SO_2NHCONH_2$ | 5.05 |
| $CH_3SO_2NHCONH_2$ | 5.10 |
| Malic acid ($pK_{a2}$) | 5.13 |
| $NH_2COC(CH_3)_2SO_2NHCONH_2$ | 5.15 |
| $NH_2COCH(CH_3)SO_2NHCONH_2$ | 5.21 |
| Pyridine | 5.23 |
| p-Toluidine | 5.30 |
| Phthalic acid ($pK_{a2}$) | 5.41 |
| m-$C_6H_5CO-C_6H_4-NHSO_2CF_2H$ | 5.44 |
| Piperazine ($pK_{a2}$) | 5.55 |
| Succinic acid ($pK_{a2}$) | 5.64 |
| Malonic acid ($pK_{a2}$) | 5.68 |
| Uric acid | 5.83 |
| Tetraethylethylenediamine ($pK_{a2}$) | 5.89 |
| Histidine ($pK_{a2}$) | 5.96 |
| 2,4,6-Trichlorophenol | 6.03 |
| 2-(N-Morpholino) ethanesulphonic acid | 6.15 |
| $C_6H_5-NHSO_2CF_2H$ | 6.19 |
| Maleic acid ($pK_{a2}$) | 6.26 |
| Dimethylarsinic acid | 6.27 |
| $NH_2SO_2CF_3$ | 6.33 |
| 3,3-Dimethylglutaric acid ($pK_{a2}$) | 6.34 |
| Carbonic acid ($pK_{a1}$) | 6.35 |
| 4-Hydroxymethylimidazole | 6.39 |
| Citric acid ($pK_{a3}$) | 6.40 |
| Orthophosphorous acid ($pK_{a2}$) | 6.5 |
| Dimethylaminoethylamine ($pK_{a2}$) | 6.50 |
| N-(2-Acetamido)iminodiacetic acid | 6.62 (20° C.) |
| Pyrophosphoric acid ($pK_{a3}$) | 6.60 |
| N,N'-Bis(3-sulphopropyl)ethylenediamine | 6.65 (18° C.) |
| Glycerol-2-phosphoric acid ($pK_{a2}$) | 6.65 |
| m-$C_6H_5CO-C_6H_4-NHSO_2CFH_2$ | 6.77 |
| Piperazine-N,N'-bis(2-ethanesulphonic acid) | 6.80 (20° C.) |
| $C_6H_5CH_2-C_6H_4-NHSO_2CF_3$ | 6.82 |
| Ethylenediamine ($pK_{a2}$) | 6.85 |
| N-(2-Acetamido)-2-aminoethanesulphonic acid | 6.88 (20° C.) |
| p-$COCH_3-C_6H_4-SO_2NH-C_6H_5$ | 6.94 (20° C.) |
| Imidazole | 6.95 |
| Arsenic acid ($pK_{a2}$) | 6.98 |
| (2-Aminoethyl)trimethylammonium chloride | 7.10 (20° C.) |
| p-Nitrophenol | 7.15 |
| N,N-Bis(2-hydroxyethyl)-2-aminoethanesulphonic acid | 7.17 (20° C.) |
| 3-(N-Morpholino) propanesulphonic acid | 7.20 (20° C.) |
| Phosphoric acid ($pK_{a2}$) | 7.20 |
| p-$NO_2-C_6H_4-SO_2NH-C_6H_5$ | 7.42 (20° C.) |

TABLE 1-continued

| Weak Acid | $pK_a$ at 25° C. |
|---|---|
| 2,4,6-Trimethylpyridine | 7.43 |
| m-$NO_2-C_6H_4-SO_2NH-C_6H_5$ | 7.50 (20° C.) |
| $CH_3NHSO_2CF_3$ | 7.56 |
| $C_6H_5-NHSO_2CF_3$ | 7.57 |
| 4-Methylimidazole | 7.67 |
| p-$CO_2H-C_6H_4-SO_2NH-C_6H_5$ ($pK_{a2}$) | 7.75 (20° C.) |
| p-$Cl-C_6H_4-SO_2NH-C_6H_5$ | 7.98 (20° C.) |
| $NH_2SO_2CF_2H$ | 8.06 |
| m-$C_6H_5CO-C_6H_4-NHSO_2CH_3$ | 8.19 |
| m-$NO_2-C_6H_4-CONHOH$ | 8.20 |
| $C_6H_5-SO_2NH-C_6H_5$ | 8.31 (20° C.) |
| p-$CH_3-C_6H_4-SO_2NH-C_6H_5$ | 8.46 (20° C.) |
| m-$NO_2-C_6H_4-SO_2NHOH$ | 8.60 |
| p-$Br-C_6H_4-CONHOH$ | 8.61 |
| p-$CH_3-C_6H_4-NHSO_2-C_6H_5$ | 8.64 (20° C.) |
| p-$CH_3O-C_6H_4-SO_2NH-C_6H_5$ | 8.66 (20° C.) |
| p-$CH_3O-C_6H_4-NHSO_2-C_6H_5$ | 8.70 (20° C.) |
| $C_6H_5-NHSO_2CH_3$ | 8.85 |
| p-$NH_2-C_6H_4-SO_2NH-C_6H_5$ | 8.89 (20° C.) |
| $C_6H_5-CONHOH$ | 8.89 |
| p-$CH_3-C_6H_4-CONHOH$ | 8.99 |
| p-$NH_2-C_6H_4-NHSO_2-C_6H_5$ | 9.05 (20° C.) |
| p-$Br-C_6H_4-SO_2NHOH$ | 9.08 |
| p-$NO_2-C_6H_4-SO_2NH_2$ | 9.14 (20° C.) |
| $NH_2SO_2CFH_2$ | 9.32 |
| $C_6H_5-SO_2NHOH$ | 9.34 |
| m-$NO_2-C_6H_4-SO_2NH_2$ | 9.40 |
| p-$CH_3-C_6H_4-SO_2NHOH$ | 9.40 |
| $NH_2COCH_2SO_2NH_2$ | 9.70 |
| p-$Cl-C_6H_4-SO_2NH_2$ | 9.77 (20° C.) |
| m-$NO_2-C_6H_4-NHNH_2$ | 9.78 |
| p-$Br-C_6H_4-SO_2NH_2$ | 9.87 |
| $NH_2COC(CH_3)_2SO_2NH_2$ | 9.92 |
| $C_6H_5-SO_2NH_2$ | 10.10 |
| p-$CH_3CONH-C_6H_4-SO_2NH_2$ | 10.02 (20° C.) |
| p-$CH_3-C_6H_4-SO_2NH_2$ | 10.24 |
| p-$CH_3O-C_6H_4-SO_2NH_2$ | 10.22 (20° C.) |
| p-$Br-C_6H_4-SO_2NHNH_2$ | 10.36 |
| $C_6H_5-SO_2NHNH_2$ | 10.60 |
| p-$NH_2-C_6H_4-SO_2NH_2$ | 10.69 |
| p-$CH_3-C_6H_4-SO_2NHNH_2$ | 10.71 |
| $NH_2SO_2CH_3$ | 10.80 |
| 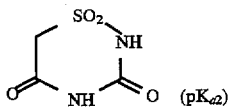 ($pK_{a2}$) | 11.00 |
| 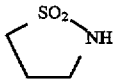 | 11.39 |
| $CH_3SO_2NHCH_3$ | 11.79 |
| $CH_3CH_2SO_2NHCH_3$ | 11.84 |
| 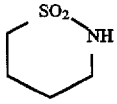 | 12.02 |

Aqueous Slurries

Aqueous slurries of the materials and substances having weak acid functional groups of the present invention are generally obtained by combining liquid water with these materials and substances in a solid or liquid form and dispersing by some means of mixing or stirring. Such means are well known in the art, and include shaking, milling, and stirring means. Dispersing aids are often usefully employed in preparing such slurries of the present invention, and these aids may be of the charged surfactant type, the nonionic surfactant type, and of the charged or uncharged polymeric type.

The formation of aqueous slurries of the materials and substances having weak acid functional groups of the present invention may be obtained by using mixtures of water and water miscible solvents. Examples of such solvents include acetone, methanol, ethanol, isopropanol, dimethylsulfoxide, and tetrahydrofuran. The water and the mixtures of water with such solvents used in forming such slurries generally have pH of 7 or less. It is preferred that the pH of such water or water and solvent mixtures be less than $pK_{a1}+3$, more preferably less than $pK_{a1}+2$, where $pK_{a1}$ is the effective pK of the weak acid groups in the materials and substances having weak acid functional groups of the present invention. If the pH of such water or water and solvent mixture is too high, too much dissolution of the materials and substances having weak acid functional groups of the present invention may occur on mixing these materials and substances with this water or water and solvent mixture.

In the present invention it is preferred to select buffering salts of weak acids, where the weak acid associated with a particular buffering salt has $pK_{a2}$, in combination with slurries containing particulate solid substances comprising weak acid functional groups having $pK_{a1}$ of the present invention, where $$pK_{a1}-2 \leqq pK_{a2},$$

so that the impact of the buffering salt on pH control will be significant. When it is desired to control pH by raising pH, it is preferred that $$pK_{a1} \leqq pK_{a2}.$$

When it is desired to control pH by increasing buffering capacity to prevent or minimize pH decreases, it is preferred that $$pK_{a2} \leqq pK_{a1}.$$

When it is desired to maintain pH within a couple of pH units of the-effective pK of the materials and substances with weak acid functional groups having $pK_{a1}$ of the present invention, it is preferred that $$pK_{a1}-2 \leqq pK_{a2},$$

and $$pK_{a2} \leqq pK_{a1}+2.$$

When buffering salts of the present invention are combined with liquid and materials and substances with weak acid functional groups having $pK_{a1}$ of the present invention to form an aqueous slurry the ionic strength of the continuous phase will increase by an incremental amount. In the slurries and methods of the present invention, such incremental increases suitably are less than 0.1 mole/L. More suitably, this incremental increase is less than 0.04 mol/L, so as to minimize coulombic screening of electrostatic stabilizing charges in such combinations. It is also preferred to keep such incremental increases in ionic strength less than 0.01 mol/L, more preferred to keep such incremental increases in ionic strength less than 0.005 mol/L, and much more preferred to keep such increases less than 0.003 mol/L, to further limit such coulombic screening, and possibly destabilizing, electrostatic effects. Ultimately, it is preferred to obtain the desired pH control using the least amount of added buffering salt necessary. The amount required may be experimentally determined by straightforward experimentation, and will depend upon the effective $pK_{a1}$ of the first chemical substance, the $pK_{a2}$ of the conjugate acid of the buffering salt, and other factors such as solubility of the various substances as a function of pH.

In some embodiments of the slurries according to the present invention, containing a particulate solid phase of a first chemical substance of low aqueous solubility having effective $pK_{a1}>1$, an aqueous continuous phase, and a buffering salt of a second chemical substance, where said second chemical substance is a weak acid having $pK_{a2}$, it is preferred that such slurries be devoid of any other weak acid of-$pK_{a3}$ that has greater than 2% (w/w) aqueous solubility at $pH=pK_{a3}$. Such a restriction serves to minimize the ionic strength of the continuous phase in such embodiments, thereby maximizing colloidal stability derived from charge-charge repulsion forces.

In some embodiments of the slurries and processes of the present invention, these slurries and processes are essentially devoid of chemical substances having weak acid functional groups of effective $pK_{a1}>1$, having low aqueous solubility at pH less than $pK_{a1}$, and having an amorphous physical state. In such embodiments, preferably less than 50%, more preferably less than 10% of such chemical substance is present in an amorphous physical state. In other embodiments of the processes of the present invention, these processes are essentially devoid of any step comprising the addition of any weak acid, other than that arising from reaction between said buffering salt and said particulate solid substance, having greater than 2% by weight aqueous solubility at $pH=pK_{a1}$ is disclosed. In other embodiments of the slurries of the present invention, these slurries are devoid of any weak acid, other than that arising from reaction between said buffering salt and said particulate solid substance, having greater than 2% by weight aqueous solubility at $pH=pK_{a1}$. Such exclusions promote reaction between protons emanating from the particulate solid substance and the acid anions of the buffering salt.

Comminution Reactors

Comminution reactors or, equivalently, milling reactors and mills for producing small particle dispersions of chemical substances, and preferably photographically useful or pharmaceutically useful chemical substances, are well known in the art, such as those described in U.S. Pat. Nos. 2,581,414 and 2,855,156, the disclosures of which are incorporated herein by reference, and such as those described in Canadian Patent No. 1,105,761. These reactors and mills include solid-particle mills such as attritors, vibration mills (SWECO, Inc., Los Angeles), ball-mills, pebble-mills, stone mills, roller-mills, shot-mills, sand-mills (P. Vollrath, Maschinenfabriken, Köln, Germany), bead-mills (Draiswerke GmbH, Mannheim, Germany), dyno-mills (W. A. Bachofen, Maschinenfabriken, Basle; Impandex Inc., New York), Masap-mills (Masap AG, Matzendorf, Switzerland), and media-mills (Netzsch, ). These mills further include colloid mills, attriter mills, containers of any suitable shape and volume for dispersing with ultrasonic energy, and containers of any suitable shape and volume for dispersing with high speed agitation, as disclosed in U.S. Pat. No. 3,486,741, incorporated herein by reference for all disclosed therein, and as disclosed by Onishi et al. in U.S. Pat. No. 4,474,872 and incorporated herein by reference for all disclosed therein. Ball-mills, roller-mills, media-mills, and attriter mills are preferred because of their ease of operation, clean-up, and reproducibility.

Milling

The slurries and colloidal dispersions of the present invention can be obtained by any of the well known mixing and milling methods known in the art, such as those methods described in U.S. Pat. Nos. 2,581,414 and 2,855,156, the disclosures of which are incorporated herein by reference, and in Canadian Patent No. 1,105,761. These methods include solid-particle milling methods such as ball-milling, pebble-milling, roller-milling, sand-milling, bead-milling (Vollrath), dyno-milling (Bachofen), Masap-milling (Masap), and media-milling. These methods further include colloid milling, milling in an attriter, dispersing with ultrasonic energy, and high speed agitation (as disclosed by Onishi et al. in U.S. Pat. No. 4,474,872 and incorporated herein by reference). Alternatively, the slurries and colloidal dispersions of the present invention can be obtained by any precipitation process known in the art, such as those involving solvent shifting and pH shifting. Methods exemplifying pH shifting are taught, for example, by Texter in U.S. Pat. Nos. 5,274,109 and 5,326,687, and by Texter et al., in U.S. application Ser. No. 07/812,503 filed Dec. 20, 1991, the disclosures of which are incorporated herein by reference for all that they disclose about precipitation.

The slurries and colloidal dispersions of the present invention can be obtained by phase conversion after oil-in-water emulsification. The particulate solid phase of a first chemical substance of low aqueous solubility having effective $pK_{a1}>1$ may be obtained by first dispersing this first chemical substance in an oil-in-water emulsions, using any of the sonication, direct, washed, or evaporated methods of preparing such an emulsion. Such methods are well known in the art and are taught in U.S. Pat. Nos. 3,676,12, 3,773,302, 4,410,624, and 5,223,385, the disclosures of which is incorporated herein by reference for all taught about dispersing substances and methods. After obtaining such an oil-in-water emulsion of a first chemical substance of the present invention, the physical state of this first chemical substance is converted to a solid physical state by any of the possible conversion processes known. These processes include lowering the temperature, so that a liquid physical state is converted to a solid physical state, removing excess organic solvent so that a molecular solution (liquid) physical state is converted to a solid physical state as a result of solubility limits being exceeded of said first chemical substance in said organic solvent, and thermal and chemical annealing processes as described in U.S. application Ser. No. 07/956,140 filed Oct. 5, 1992, now U.S. Pat. No. 5,401,623, the disclosures of which is incorporated herein for all taught about dispersing processes and phase conversion.

The formation of colloidal dispersions, of the materials and substances having weak acid functional groups of the present invention, in aqueous media usually requires the presence of dispersing aids such as surfactants and surface active polymers. Such dispersing aids have been disclosed by Chari et al. in U.S. Pat. No. 5,008,179 (columns 13–14) and by Bagchi and Sargeant in U.S. Pat. No. 5,104,776 (see columns 7–13) and are incorporated herein by reference. Preferred dispersing aids include sodium dodecyl sulfate, sodium dodecyl benzene sulfonate, Aerosol-OT (Cyanamid), Aerosol-22 (Cyanamid), Aerosol-MA (Cyanamid), sodium bis(phenylethyl)sulfosuccinate, sodium bis(2-ethylpentyl) sulfosuccinate, Alkanol-XC (Du Pont), Olin 10G (Dixie), Polystep B-23 (Stepan), Triton® TX-102 (Rohm & Haas), Triton TX-200, Tricol LAL-23 (Emery), Avanel S-150 (PPG), Aerosol A-102 (Cyanamid), and Aerosol A-103 (Cyanamid), Such dispersing aids are typically added at level of 1%–200% of dispersed substance (by weight), and are typically added at preferred levels of 3%–30% of dispersed substance (by weight).

Suitable ceramic media for use in milling include glass beads, quartz sand, and carbide sand. Particularly preferred ceramic media include zirconia media, zircon media, and yttrium stabilized ceramic media. Suitable polymeric media for use in milling include polystyrene beads crosslinked with divinylbenzene. Mixtures of ceramic materials and polymeric materials in such media are useful.

Suitable operating conditions for various types of mills and media are taught in detail in Chapters 17–24 of *Paint Flow and Pigment Dispersion,* Second Edition, by T. C. Patton and published by John Wiley & Sons, New York, 1979. Technical aspects of dispersion using various types of mills and media are also taught by D. A. Wheeler in Chapter 7, pages 327–361 of *Dispersion of Powders in Liquids,* Third Edition, edited by G. D. Parfitt and published by Applied Science Publishers, London, 1981.

The following examples illustrate the practice of this invention. They are not intended to be exhaustive of all possible variations of the invention. Parts and percentages are by weight unless otherwise indicated.

EXAMPLES

Particulate Chemical Substance

Chemical substance FD1, a magenta colored filter dye, was prepared as described by Factor and Diehl in U.S. Pat. No. 4,855,221, the disclosure of which is incorporated herein by reference.

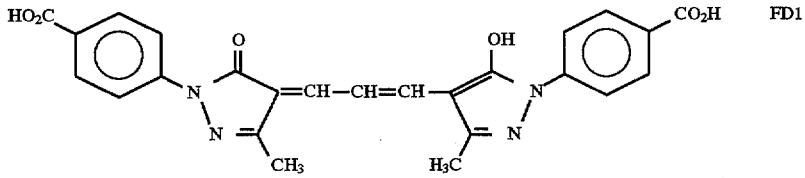

FD1

Slurries and Suspensions

A small particle sized slurry of FD1 in water was prepared using sodium oleoylmethyl taurine (OMT) as a dispersing aid. An 8% (w/w) suspension of FD1 in aqueous OMT was circulated through an LME 4-liter Netzsch mill (Netzsch, Inc., Exton, Pa.) using 0.7 mm mean diameter zircon media (SEPR, Mountainside, N.J.) at a media load of 80% and a residence time of 90 minutes. The agitation pegs were a mixture of stainless steel and tungsten-carbide; about 75% of the pegs were stainless steel. At the cessation of milling, this slurry was diluted with water to yield a final FD1 concentration of 4% (w/w). This slurry is denoted S1.

Two additional slurries were prepared similarly, except that no dispersing aid at all was used, the media load was 90%, and the residence time was 70 minutes. The resulting slurries were about 7% (w/w), and were not diluted after milling. One of these slurries was obtained using stainless steel agitation pegs, and is denoted S2. The other slurry was obtained using tungsten-carbide pegs, and is denoted S3.

Characterization of Slurries

Particle size distributions of these three slurries were examined by capillary hydrodynamic fractionation, using a Model CHDF-1100 instrument (Matec Applied Sciences, Hopkinton, Mass.). This method of sizing small particles is described by Silebi and Dos Ramos in U.S. Pat. No. 5,089,126. The weight-average equivalent spherical diameter obtained for slurry S1 was 95 nm. The weight average equivalent spherical diameters obtained for S2 and S3 were 380 and 340 nm, respectively.

Electrokinetic measurements were made by measuring electroacoustic sonic amplitude (ESA) at 23°–24° C. with a MBS-8000 system (Matec Applied Sciences, Inc., Hopkinton, Mass.) electrokinetic sonic analysis system. The principles of this system are described by Oja et al. in U.S. Pat. No. 4,497,208. Measurements controlled by Matec STESA software in the single-point mode were made using a low volume parallel-plate flow-cell (Matec Model PPL-80) for sampling the slurries. A flow diagram of this system is illustrated in FIG. 1 of Klingbiel, Coll, James, and Texter, published in *Colloids Surfaces,* 68, 103 (1992). A Wavetek Model 23 waveform generator was used as a radio-frequency source; the frequency was tuned so that the electrode separation was 3/2 wavelengths of the pressure (acoustic) waves. The ESA signal, S, was monitored on an Iwatsu Model SS-5510 oscilloscope. The instrumental constant for calibrating the response was obtained as described by Klingbiel et al. in the above cited *Colloids Surfaces* publication and in the *International Symposium on Surface Charge Characterization, San Diego, Calif., August* 1990, K. Oka, Editor, Fine Particle Society, Tulsa, Okla., pp. 20–21 (1990), and by James, Texter, and Scales in *Langmuir,* 7, 1993 (1991). Aqueous slurries of Ludox-TM (Du Pont) at 0.5, 1.33, and 4.0% (v/v) were used in the calibration of the ESA system. The volume fraction dependence of the ESA of these standard slurries was adjusted with an instrumental constant, to yield a response, $dS/d\phi$, of −63.8 mPa m/V.

The pH dependence of the ESA for S1 is illustrated in FIG. 1. The intrinsic pH of about 4 was lowered with added nitric acid dropwise, and the ESA exhibited an S-shaped response with an apparent pK of about 2.3. At present it is not certain if this reflects protonation of the surfactant OMT or if it reflects protonation of the most acidic site, the chromophoric hydroxyl, of the dye molecule. The data of FIG. 2 as discussed in the next paragraph, support an interpretation that this pK reflects chromophoric hydroxyl ionization, but protonation of the OMT sulfo group may also be involved. The shift to about, pH 4 for the onset of negative electrokinetic charge reduction, with decreasing pH, unequivocally points to the importance of OMT in maintaining negative surface charge in the pH 4–5 interval.

Figure 2:
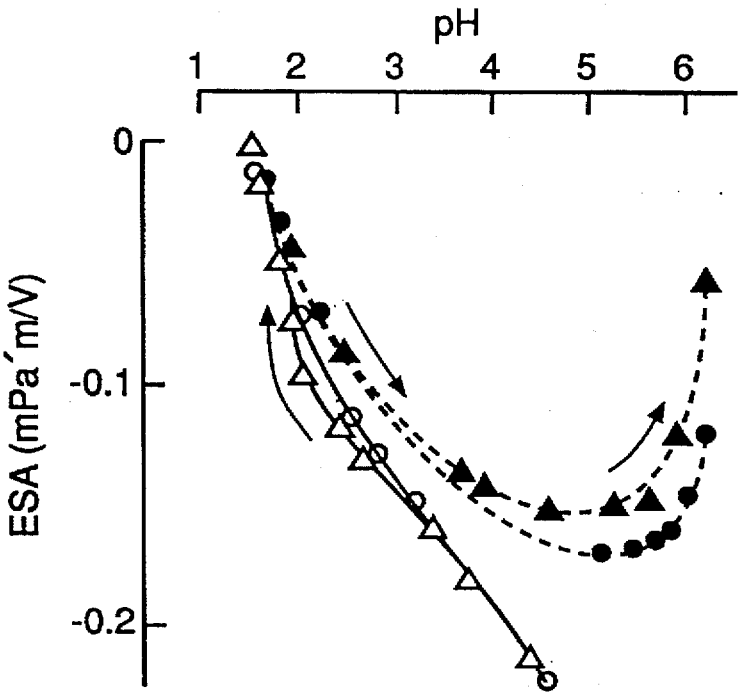
FIG. 2. ESA as a function of pH for FD1 slurries S2 and S3.

The electrokinetics of S2 and S3 are compared in FIG. 2 as a function of pH. There does not appear a significant effect of tungsten pegs on the electrokinetics of these dye slurries. The hysteresis is most probably due to the local dissolution effects of the added NaOH. The upturn in ESA with increasing pH above pH 5 is due to the marked increased solubility of the dye in this pH range. These pH profiles differ significantly from the profile published by Texter (*Langmuir,* 8, 291 (1992)) for the monomethine homologue (FD2) of FD1. The ESA-pH profile published for an FD2 slurry prepared in the absence of surfactant exhibited a marked, abrupt S-shaped transition over the pH interval of 4–6 and reflected a predominately carboxy group-based surface $pK_a$ of about 5.0. The molecular packing, particle morphology, and accessibility of the very acidic chromophoric "hydroxyl" proton of these dye homologues probably differ significantly. The pH profile illustrated in FIG. 2 suggests that the chromophoric "hydroxyl" proton is very accessible in these FD1 slurries, since the lowest apparent $pK_a$ is about 2, three pH units lower than that observed for FD2. These results show that the intrinsic electrokinetic charge of FD1 is negative, as was shown earlier by Texter (*Langmuir*, 8, 291 (1992)) for FD2.

Buffering Salts

Aqueous solutions of sodium salts of the weak acids listed in Table 2 were prepared at a concentration of about 0.1 mole/liter. Aqueous sodium acetate was prepared from anhydrous sodium acetate (Johnson Mathey; f.w.=82.03); aqueous monosodium citrate was prepared from monosodium citrate dihydrate (Johnson Mathey; f.w.=294.1); aqueous monosodium tartarate was prepared from disodium tartarate dihydrate (Johnson Mathey; f.w.=230.08); aqueous sodium benzoate was prepared from sodium benzoate (Kodak Laboratory Chemicals; f.w.=95.48); aqueous sodium salicylate was prepared from sodium salicylate (Johnson Mathey; f.w.=160.1).

TABLE 2#

| Weak Acid | $PK_a$ |
|---|---|
| Acetic Acid | $PK_{a1} = 4.76$ |
| Benzoic Acid | $PK_{a1} = 4.2$ |
| Citric Acid | $PK_{a1} = 3.13$ |
| | $PK_{a2} = 4.76$ |
| | $PK_{a3} = 6.4$ |
| Salicylic Acid | $PK_{a1} = 2.98$ |
| Tartaric Acid | $PK_{a1} = 3.04$ |
| | $PK_{a2} = 4.37$ |

#Values of $pK_a$ taken from Buffers for pH and Metal Ion Control by D. D. Perrin and B. Dempsey, Chapman and Hall, New York (1974).

EXAMPLES 1–28

Measurements of pH were made using a Corning combination pH electrode, calibrated with VWR buffers of pH 4.0 and pH 7.0, using a Radiometer Copenhagen PHM63 pH meter. Equilibrated measurements were taken at about 24° C. while stirring the solutions or slurries. The FD1 slurry had a pH of 4.07±0.07.

About 97.0 g of the above described S1 slurry were placed in a 200 mL beaker upon a magnetic stirrer, and this slurry was moderately stirred using a magnetic stirring bar. The pH was measured, and then aliquots of 0.1 mole/L aqueous sodium acetate were added, and pH was recorded after each addition. Results are illustrated in Table 3, and show that addition of only a small amount of aqueous sodium acetate increases the slurry pH to a significant extent.

TABLE 3

Sodium Acetate Buffering

| Example | Total mL of 0.1 mole/L Aqueous Sodium Acetate Added | pH Measured |
|---|---|---|
| 1 (control) | 0 | 4.08 |
| 2 | 1 | 4.48 |
| 3 | 2 | 4.64 |
| 4 | 3 | 4.75 |
| 5 | 4 | 4.83 |
| 6 | 5 | 4.90 |

About 93.9 g of the above described S1 slurry were placed in a 200 mL beaker upon a magnetic stirrer, and was moderately stirred. The pH was measured as 4.12. Aliquots of 0.1 mole/L aqueous sodium citrate were added, and pH was recorded after each addition. Results are illustrated in Table 4, and show that addition of only a small amount of aqueous sodium acetate significantly increases the slurry pH.

TABLE 4

Sodium Citrate Buffering

| Example | Total mL of 0.1 mole/L Aqueous Sodium Citrate Added | pH Measured |
|---|---|---|
| 7 (control) | 0 | 4.12 |
| 8 | 1 | 4.68 |
| 9 | 2 | 4.99 |
| 10 | 3 | 5.20 |
| 11 | 4 | 5.34 |

About 95.7 g of the above described S1 slurry were placed in a 200 mL beaker with moderate stirring. The slurry had a pH of 4.07. Aliquots of 0.1 mole/L aqueous sodium tartrate were added, and pH was recorded. Results are illustrated in Table 5, and show that addition of only a small amount of aqueous sodium acetate increases the slurry pH to a significant extent.

TABLE 5

Sodium Tartrate Buffering

| Example | Total mL of 0.1 mole/L Aqueous Disodium Tartrate Added | pH Measured |
|---|---|---|
| 12 (control) | 0 | 4.07 |
| 13 | 1 | 4.23 |
| 14 | 2 | 4.32 |
| 15 | 3 | 4.40 |
| 16 | 4 | 4.46 |

About 95.4 g of the above described S1 slurry were placed in a 200 mL beaker and was moderately stirred. The pH was measured before and after additions of aliquots of 0.1 mole/L aqueous sodium benzoate, and the results are illustrated in Table 6. Sodium benzoate also is very effective at providing significant pH control at relatively low concentrations.

TABLE 6

Sodium Benzoate Buffering

| Example | Total mL of 0.1 mole/L Aqueous Sodium Benzoate Added | pH Measured |
|---|---|---|
| 17 (control) | 0 | 4.05 |
| 18 | 1 | 4.28 |
| 19 | 2 | 4.42 |
| 20 | 3 | 4.52 |
| 21 | 4 | 4.59 |
| 22 | 5 | 4.64 |

About 93.3 g of the above described S1 slurry were placed in a 200 mL beaker and stirred. The pH was measured as 4.04. Aliquots of 0.1 mole/L aqueous sodium salicylate were added, and pH was recorded after each addition. Results are illustrated in Table 7, and show that aqueous sodium salicylate provides some pH control, but that the effect is less than that exhibited comparatively to the earlier examples, because salicylic acid is essentially completely ionized at the pH of the S1 slurry, and the salicylic anion has a relatively small driving force for scavenging protons from solution.

TABLE 7

Sodium Salicylate Buffering

| Example | Total mL of 0.1 mole/L Aqueous Sodium Salicylate Added | pH Measured |
|---|---|---|
| 23 (control) | 0 | 4.00 |
| 24 | 1 | 4.04 |
| 25 | 2 | 4.06 |
| 26 | 3 | 4.09 |
| 27 | 4 | 4.12 |
| 28 | 5 | 4.14 |

The present invention has been described in some detail with particular reference to preferred embodiments thereof. It will be understood that variations and modifications can be effected within the spirit and scope of the present invention.

What we claim is:

1. A process for buffering concentrated aqueous slurries comprising the steps of:

providing a particulate solid substance comprising a weak acid functional group, having effective $pK_{a1}>1$ and less than 1% by weight aqueous solubility at $pH=pK_{a1}$;

providing an aqueous solution consisting essentially of water or a mixture of water with water-miscible solvent, at pH less than the greater of 7 and $pK_{a1}+2$;

providing a buffering salt of a weak acid, where the weak acid associated with this buffering salt has $pK_{a2}$ and where $pK_{a1}-2 \leqq pK_{a2}$; and combining said aqueous solution, said particulate solid substance, and said buffering salt to form a slurry;

wherein said process is essentially devoid of any step comprising the addition of any weak acid, other than that arising from reaction between said buffering salt and said particulate solid substance, having greater than 2% by weight aqueous solubility at $pH=pK_{a1}$.

2. A process according to claim 1, where $pK_{a1} \leqq pK_{a2}$.

3. A process according to claim 1, where $pK_{a2} \leqq pK_{a1}$.

4. A process according to claim 1, where $pK_{a2} \leqq pK_{a1}+2$.

5. A process according to claim 1, wherein said particulate solid substance is a photographically useful compound.

6. A process according to claim 1, wherein said particulate solid substance is a photographically useful sensitizing dye, filter dye, coupler, developer, blocked developer, electron transfer agent, or redox dye releaser.

7. A process according to claim 1, wherein said particulate solid substance is one of the following:

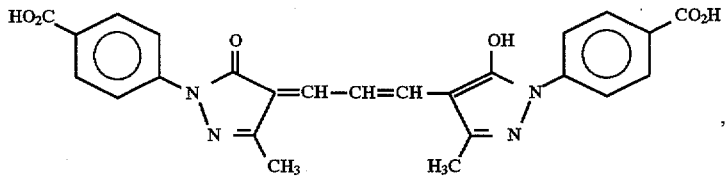

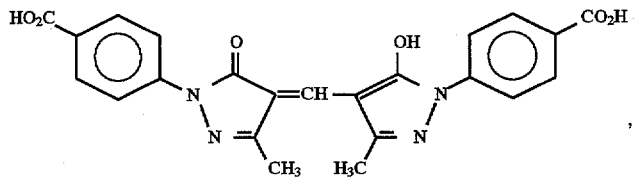

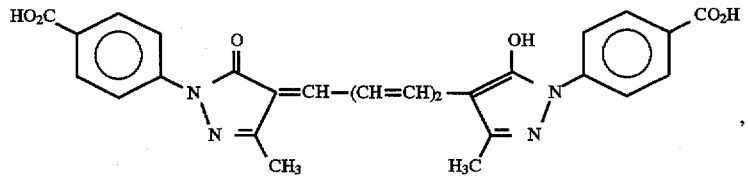

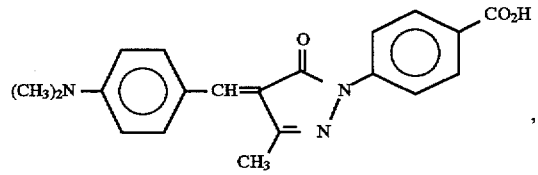

-continued

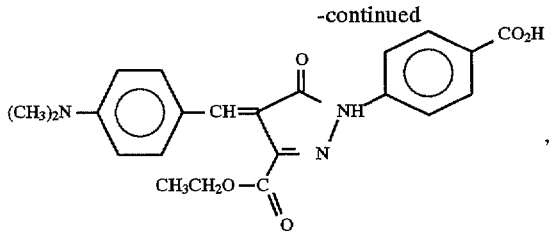

, or

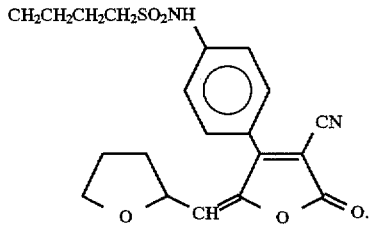

8. A process according to claim 1, wherein said weak acid functional group of said particulate solid substance is a —COOH group.

9. A process according to claim 1, wherein said weak acid functional group of said particulate solid substance is an —$SO_2NHR$ group, where R is H, a substituted or unsubstituted alkyl group, or a substituted or unsubstituted aryl group, or a substituted or unsubstituted heterocyclic group.

10. A process according to claim 1, wherein said buffering salt is a salt of a carboxcylic acid.

11. A process according to claim 1, wherein said buffering salt is an alkali metal salt of a carboxcylic acid.

12. A process according to claim 1, wherein said buffering salt comprises a surface active anion that adsorbs to the surface of said particulate solid substance.

13. A process according to claim 1, wherein the incremental molar ionic strength in the continuous phase of said slurry resulting from said providing a buffering salt step is less than 0.04 mol/L.

14. A process according to claim 1, wherein the incremental molar ionic strength in the continuous phase of said slurry resulting from said providing a buffering salt step is less than 0.003 mol/L.

15. A process according to claim 1, wherein said particulate solid substance is a pharmaceutically useful material.

* * * * *